US012098721B2

(12) United States Patent
Su et al.

(10) Patent No.: US 12,098,721 B2
(45) Date of Patent: Sep. 24, 2024

(54) SEALING AND COMPLIANCE IN A SCROLL COMPRESSOR

(71) Applicant: Copeland Europe Gmbh, Berlin (DE)

(72) Inventors: Xiaogeng Su, Welkenraedt (BE); Laurence Grosjean, Welkenraedt (BE); Marco Alonso Cardenas-Ruiz, Welkenraedt (BE); Vincent Cloosen, Welkenraedt (BE); Sheng Liang, Welkenraedt (BE)

(73) Assignee: Copeland Europe GmbH, Berlin (DE)

( * ) Notice: Subject to any disclaimer, the term of this patent is extended or adjusted under 35 U.S.C. 154(b) by 0 days.

(21) Appl. No.: 17/848,358

(22) Filed: Jun. 23, 2022

(65) Prior Publication Data

US 2022/0412348 A1 Dec. 29, 2022

(30) Foreign Application Priority Data

Jun. 23, 2021 (EP) ..... 21181153

(51) Int. Cl.
*F03C 2/00* (2006.01)
*F03C 4/00* (2006.01)
(Continued)

(52) U.S. Cl.
CPC ..... *F04C 2/025* (2013.01); *F04C 15/0003* (2013.01); *F04C 18/0215* (2013.01);
(Continued)

(58) Field of Classification Search
CPC .. F04C 2/025; F04C 18/0215; F04C 18/0253; F04C 15/0003; F04C 15/0007;
(Continued)

(56) References Cited

U.S. PATENT DOCUMENTS 2,283,871 A * 5/1942 Norelius ..... F16J 15/3564 277/366
4,311,317 A * 1/1982 Bartels ..... F16J 15/025 277/648

(Continued)

FOREIGN PATENT DOCUMENTS

JP 2001032784 A 2/2001
WO 2016124120 A1 8/2016

OTHER PUBLICATIONS

Extended Search Report mailed Dec. 20, 2021, in corresponding European Application No. 21181153.4.

*Primary Examiner* — Theresa Trieu
(74) *Attorney, Agent, or Firm* — Harness, Dickey & Pierce, P.L.C.

(57) ABSTRACT

A scroll compressor is described. The scroll compressor comprises a case having a high-pressure side and a low-pressure side, a stationary scroll plate having a base plate with a first side having at least one projection, which forms a spiral wrap, and a second side having a first annular protrusion, a pilot plate for separating the high-pressure side of the case from the low-pressure side of the case and the pilot plate abutting the second side of the stationary scroll plate, wherein the pilot plate has a first side, wherein the first side faces the second side of the stationary scroll plate and wherein the first side has a second annular protrusion, and a seal, wherein the seal seals a radial gap between the first annular protrusion and the second annular protrusion.

12 Claims, 9 Drawing Sheets

(51) Int. Cl.

| | |
|---|---|
| ***F04C 2/00*** | (2006.01) |
| ***F04C 2/02*** | (2006.01) |
| ***F04C 15/00*** | (2006.01) |
| ***F04C 18/00*** | (2006.01) |
| ***F04C 18/02*** | (2006.01) |
| ***F04C 27/00*** | (2006.01) |
| *F04C 23/00* | (2006.01) |

(52) U.S. Cl.
CPC ..... *F04C 27/001* (2013.01); *F04C 27/005* (2013.01); *F04C 23/008* (2013.01); *F04C 2240/30* (2013.01)

(58) Field of Classification Search
CPC .. F04C 15/0015; F04C 23/008; F04C 27/001; F04C 27/003; F04C 27/007; F04C 2240/30; F16J 15/022; F16J 15/025; F16J 15/3204; F16J 15/3232
See application file for complete search history.

(56) References Cited

U.S. PATENT DOCUMENTS

| | | | | |
|---|---|---|---|---|
| 5,257,920 | A * | 11/1993 | Takeda | F04C 18/0215 418/55.1 |
| 5,447,418 | A * | 9/1995 | Takeda | F04C 27/005 418/55.4 |
| 2003/0000238 | A1* | 1/2003 | Uchida | F04C 27/005 418/55.5 |
| 2003/0012659 | A1* | 1/2003 | Seibel | F04C 18/0215 418/55.1 |
| 2009/0068048 | A1 | 3/2009 | Stover et al. | |
| 2009/0087332 | A1* | 4/2009 | Stover | F04C 27/005 418/55.4 |
| 2014/0202257 | A1* | 7/2014 | Bahr | F16J 15/022 277/644 |

* cited by examiner

SEALING AND COMPLIANCE IN A SCROLL COMPRESSOR

CROSS-REFERENCE TO RELATED APPLICATIONS

This application claims priority to European Application No. 21181153.4 filed Jun. 23, 2021, the entire disclosure of which is incorporated herein by reference.

FIELD

The current application relates to improving sealing and compliance in a scroll compressor, wherein such compressor could be used, for example, in refrigeration systems. In particular, the current application provides improved sealing between a low-pressure portion of the scroll-compressor and a high-pressure portion of the scroll compressor.

BACKGROUND

A compressor is an apparatus, which reduces the volume of a fluid by increasing the pressure of the fluid. In most common applications, the fluid is a gas.

Compressors are used, for example, in refrigeration systems. In a common refrigeration system, a refrigerant is circulated through a refrigeration cycle. Upon circulation, the refrigerant undergoes changes in thermodynamic properties in different parts of the refrigeration system and transports heat from one part of the refrigeration system to another part of the refrigeration system. The refrigerant is a fluid, i.e. a liquid or a vapour or gas. Examples of refrigerants may be artificial refrigerants like fluorocarbons. However, in recent applications, the use of carbon dioxide, $CO_2$, which is a non-artificial refrigerant, has become more and more important, because it is non-hazardous to the environment. The present description illustrates the functionality of the compressor in connection with a refrigeration system. However, this is only one example and the described functionality could be used in various systems and different kinds of fluids, not only refrigerants.

A typical scroll compressor comprises a high-pressure side and a low-pressure side. At the low-pressure side the fluid enters the scroll compressor via a suction port, for example from a refrigeration cycle. The fluid is provided to a means for compressing, where it will be compressed. The compressed fluid will then be provided to the high-pressure side. At the high-pressure side compressed fluid is collected and leaves the scroll compressor via a discharge port, for example back to the refrigeration cycle. Compressing the refrigerant in the means for compressing reduces the volume of the refrigerant, while increasing its pressure and temperature.

Within the case of the compressor, the high-pressure side and the low-pressure side are separated from one another. A passage from the low-pressure side to the high-pressure side is formed by the means for compressing. In other words, the means for compressing may form a transition area from the low-pressure side to the high-pressure side.

In a scroll compressor, the means for compressing is formed by a scroll set, which comprises scroll plates, typically a stationary scroll plate and an orbiting scroll plate. Each of these scroll plates has a base plate and a projection in form of a spiral wrap, which extends from the base plate. In the assembled scroll compressor, the projections are interleaved, so that when the orbiting scroll plate moves relatively to the stationary scroll plate, refrigerant received from the suction port will be enclosed between the base plates and the interleaved projections. During the relative motion, the refrigerant will be moved within the interleaved projections from the outside of the interleaved spiral wraps towards the center of the scroll plates, i.e. the center of the projections. Thereby, the refrigerant will be compressed. When the compressed refrigerant reaches the center of the scroll plates, i.e. the center of the interleaved projections, the compressed refrigerant can be ejected from the scroll set through an opening in the base plate of the stationary scroll plate and into a high-pressure side of the scroll compressor from where the compressed refrigerant can be discharged through the discharge port.

The compression of the refrigerant increases the pressure of the refrigerant inside the scroll set. As such, the scroll set forms the passage or transition area between the low-pressure side of the scroll compressor and the high-pressure side of the scroll compressor. Sealing of compression chambers formed within the scroll set occurs by ease of lubricant, which lubricates the scroll plates, in particular their spiral wrap-shaped projections and the side of their base plates, which comprise said projections.

Further, the passage from the low-pressure side of the scroll compressor to the high-pressure side of the scroll compressor needs to be sealed, in order to prevent leakage. In a typical compressor, as is for example illustrated in FIG. 1, a portion of the case forms a boundary, which separates the high-pressure side from the low-pressure side, and a passage through said boundary is provided by a scroll set. A seal is placed between the stationary scroll plate of the scroll set and the boundary in order to seal a gap that is created between the boundary and the stationary scroll plate. Said gap is referred to as an axial gap. As such, the axial gap is a gap between the bottom surface of the boundary, which separates the high-pressure side from the low-pressure side, and the top surface of the stationary scroll plate. The gap is referred to as axial gap because the gap extends between the two components (i.e. stationary scroll plate and boundary) in an axial direction, e.g. the height of the compressor case. Since the axial gap is formed between two components, which are three-dimensional objects, the person skilled in the art will appreciate that the axial gap also extends radially, i.e. in a direction perpendicular to the axial direction. However, this is a consequence of the spatial dimensions of the components and does not mean that the gap is a radial. Instead, the definition of the axial gap is based on the fact that the components between which the gap is formed are adjacent to one another in an axial direction, such that a gap along the axial direction needs to be sealed. This aspect will be described below in more detail with respect to FIG. 1, which illustrates a scroll compressor according to the state of the art.

An axial gap has a quite large gap size of approximately 1 mm. Caused by manufacturing variations and deformation of the components of the scroll compressor due to pressure differential during operation, the size of the axial gap may change during operation of the compressor. Thereby, gap sizes of 0.2 to 1 mm are common. Such a change of the gap size causes wear at the seal and may create leakage in case that the seal is not capable of tightly sealing the axial gap. For example, for large gap sizes of approximately 1 mm, the seal may be squeezed into the gap, when the compressor operates at conditions with high pressure differential between low-pressure side and high-pressure side.

Hence, there is a need in the art for improving sealing of the high-pressure side and the low-pressure side in a scroll compressor.

The above-mentioned need is fulfilled by a scroll compressor according to the current invention. The scroll compressor comprises a case, which has a high-pressure side and a low-pressure side.

SUMMARY

Further, the scroll compressor comprises a stationary scroll plate, which has a base plate with a first side. The first side comprises at least one projection, which forms a spiral wrap. In some preferred embodiments, the first side may be referred to as bottom side. Further, the base plate comprises a second side, which has a first annular protrusion. In some preferred embodiments, the second side may be referred to as top side. The first and second sides of the base plate may oppose each other.

Also, the scroll compressor comprises a pilot plate for separating the high-pressure side of the case from the low-pressure side of the case. The pilot plate abuts the second side of the stationary scroll plate, wherein the pilot plate has a first side with a second annular protrusion. The first annular protrusion of the second side of the stationary scroll plate and the second annular protrusion of the pilot plate may be in close proximity to one another. In this regard, close proximity means that the first and second protrusions are placed close towards one another but do barely not contact each other, thereby creating a small gap between the first protrusion and the second protrusion. For example, the first and second protrusions may be interleaved but do not contact one another. Alternatively, it may be possible that portions of the first and second protrusions contact each other, but this contact does not form a hermetically sealed interface. Accordingly, a small gap still is formed between the first and second protrusions, which is at least permeable to gas. The interleaved arrangement of the stationary scroll plate and the pilot plate provides for a floating connection between the stationary scroll plate and the pilot plate. Thereby, the stationary scroll plate is not tightly fixed at the pilot plate. Instead, the floating connection allows the stationary scroll plate to perform slight movements relatively to the pilot plate.

The first annular protrusion of the stationary scroll plate may extend axially from the second side of the stationary scroll plate and the second annular protrusion of the pilot plate may extend axially from the first side of the pilot plate.

Because of the arrangement of the first and second annular protrusions, is the gap formed between the first annular protrusion and the second annular protrusion is a radial gap. In this regard, radial refers to a direction perpendicular to the axial direction, which is for example given by the height of the compressor. This radial gap is formed by the radial space between axial extending surfaces of the first and second annular protrusions. This is different to the prior art, in which an axial gap is formed between radially extending surfaces of a stationary scroll plate and of a boundary.

In order to provide for best results, the first annular protrusion and the second annular protrusion may form concentric rings. Furthermore, the inner diameter of the first annular protrusion of the stationary scroll plate and the outer diameter of the second annular protrusion of the pilot plate may have approximately the same size, so that they provide for a small radial gap between the first and second annular protrusions. This way, the second annular protrusion may be located within the circular area formed by the first annular protrusion of the stationary scroll plate. Alternatively, the outer diameter of the first annular protrusion of the stationary scroll plate and the inner diameter of the second annular protrusion of the pilot plate may have approximately the same size. This way, the first annular protrusion may be located within the circular area formed by the second annular protrusion of the pilot plate.

Further, the scroll compressor comprises a seal, which seals said radial gap between the first annular protrusion and the second annular protrusion.

Providing first and second protrusions at the second side of the stationary scroll plate and the first side of the pilot plate, respectively, provides for an arrangement of the stationary scroll plate and the pilot plate, which separates the high-pressure side and the low-pressure side and replaces the axial gap with a radial gap, which is smaller in size. As such, a smaller gap can more easily be sealed and reduces seal deformation and improves the reliability of the seal. Furthermore, an axial gap as known in the art can change its size during operation of the compressor due to the pressure differential across the boundary between the low-pressure side and the high-pressure side because the increased pressure differential across the boundary may push the boundary towards the stationary scroll plate in the axial direction. In the compressor according to the current invention, the influences of the increased pressure differential on the radial gap are neglectable, since the radial gap does not change its size when the relative position between the pilot plate and the stationary scroll plate changes axially.

In the following, further preferred embodiments of the current invention are described.

In a preferred embodiment, the seal has an annular shape with an L-shaped cross-section. The annular shape allows for sealing the radial gap over the entire circumference of the first annular protrusion. The L-shaped cross-section may have a first leg and a second leg. The first leg may extend from an annular body of the annular seal into the center of its annular shape. The second leg may extend from the annular body of the annular seal in an angle of approximately 90 degree with respect to the first leg. Thereby, the first and second legs may form the L-shaped cross-section of the seal. The first leg may contact the second annular protrusion of the pilot plate and the second leg may contact the first annular protrusion of the stationary scroll plate. For example, the first leg may abut a front surface of the second annular protrusion and the second leg may abut a side of the first annular protrusion. Alternatively, for example if the inner diameter of the first annular protrusion is smaller than the inner diameter of the second annular protrusion, the first leg may abut a front surface of the first annular protrusion and the second leg may abut a side of the second annular protrusion.

Further, a step may be located between the first leg and the second leg at the side which forms the 90-degree angle between the first and second legs. Said step between the first and second legs may improve the durability of the seal. The step may stiffen the seal, so that it is prevented from being squeezed into the radial gap.

Further, a taper may be added to the first leg, i.e. the leg that abuts the front surface of either of the protrusions. Adding a taper means that at least one side of the first leg may be tapered. Thereby, the first leg may have a wedge-like shape. A wedge-shaped leg may have a surface that forms an inclined plane with respect to the approximately 90 degree between the first leg and the second leg. For example, the inclined plane may have an angle of approximately 5 degree. The taper may be added to the exterior surface of the leg, i.e. the surface that abuts the front surface of either of the protrusions. Alternatively or additionally, the taper may be added to the surface of the leg that opposes the aforementioned surface that abuts the front surface of the protrusion, i.e. the taper may be added to the surface of the leg that faces away from the front surface of the annular protrusion. Such a tapered surface may improve the fit of the seal to the respective protrusion and may reduce buckling of the seal.

In a preferred embodiment, a ring may be placed at the radial gap between the first annular protrusion and the second annular protrusion, thereby creating another radial gap between the respective protrusion and the respective leg of the seal and an axial gap between the other protrusion and the other leg. The ring may have a rectangular cross-section. The L-shaped seal may further comprise an annular recess opposite to the step. The ring may be placed within said recess. The ring may float within the first annular protrusion. Thereby, the ring may reduce the maximum radial gap that the seal needs to seal, which further improves the sealing. The ring may be made of a material which has a similar thermal expansion property as the stationary scroll plate. Preferably, the ring may be a metal ring. However, also non-metal materials, which have similar thermal expansion properties, are also possible.

In a preferred embodiment, the seal may be assembled on a seal plate. The seal plate may be made from a material with similar thermal expansion properties as the stationary scroll plate, preferably steel or cast iron. Assembling the seal on a seal plate may provide improved stability of the seal, in particular a stable form of the seal. When fabricating the seal, the exterior surfaces are fine-prepared after the seal is pressed to the seal plate, thereby reducing the magnitude of seal shrinkage when the temperature of the seal drops, because size reduction of the seal is limited by the sealing plate.

In a preferred embodiment, the seal may be made from a non-metal material. Examples of such materials may be synthetic polymers preferably composed of polyamides, such as nylon, polytetrafluoroethylene (PTFE), polyether ether ketone (PEEK) or polyimide-based plastics (e.g. Vespel).

In a preferred embodiment, the second side of the stationary scroll plate may further comprise a third annular protrusion having a smaller diameter than the first annular protrusion and the first side of the pilot plate may further comprise a fourth annular protrusion having smaller diameter than the second annular protrusion. In the assembled scroll compressor, the third annular protrusion and the fourth annular protrusion may be in close proximity to one another, as has been described earlier with respect to the first and second annular protrusions. Between the third annular protrusion and the fourth annular protrusion, a radial gap is formed, similar what has been described with respect to the radial gap formed between the first and second annular protrusions. Additionally, to the aforementioned seal, which may be referred to as first seal, the compressor may further comprise a second seal. Then, the radial gap between the first and second annular protrusions may be sealed by the first seal and the radial gap between the third and fourth annular protrusions may be sealed by the second seal.

Further, an intermediate pressure cavity may be formed between the first side of the pilot plate and the second side of the stationary scroll plate as well as the first, second, third and fourth protrusions. As such, the first and second annular protrusions in conjunction with the first seal may form a first barrier, which separates the intermediate pressure cavity from the low-pressure side. Similarly, the third and fourth protrusions in conjunction with the second seal may form a second barrier, which separates the intermediate pressure cavity from the high-pressure side. In the intermediate pressure cavity, the pressure may be higher than the pressure in the low-pressure side, but lower than the pressure in the high-pressure side. Further, by sealing the radial gap between the first and second annular protrusions, the first seal may seal the intermediate pressure cavity from the low-pressure side. Also, by sealing the radial gap between the third and fourth annular protrusions, the second seal may seal the intermediate pressure cavity from the high-pressure side.

Besides the stationary scroll plate, the compressor may also comprise an orbiting scroll plate. The orbiting scroll plate and the stationary scroll plate may form a means for compressing. The stationary scroll plate may comprise an opening, which forms an outlet of the means for compressing and the pilot plate may comprise a corresponding opening. Both openings may form a channel from the means for compressing to the high-pressure side. Via this channel, compressed fluid, which exits the means for compressing, may be provided to the high-pressure side. As such, the barrier formed by the third and fourth protrusions in conjunction with the second seal separates the intermediate pressure cavity also from the channel between the means for compressing and the high-pressure side. The second seal may have any of the abovementioned configurations that have been described for the first seal.

Further, a bleed hole may be provided that connects the intermediate pressure cavity at least temporarily during operation of the scroll compressor to a compression chamber formed in a scroll set of the scroll compressor in order to provide for pressure balancing.

The abovementioned preferred embodiments are not mutually exclusive. This means that features described for some preferred embodiments may also be utilized in some other preferred embodiments unless it is clear from the description that these features cannot be combined.

DRAWINGS

In the drawings, like reference characters generally refer to the same parts throughout the different drawings. The drawings are not necessarily to scale, emphasis instead generally being placed upon illustrating the principles of the invention.

In the following description, various embodiments of the invention are described with reference to the following drawings, in which.

Figure 3A:
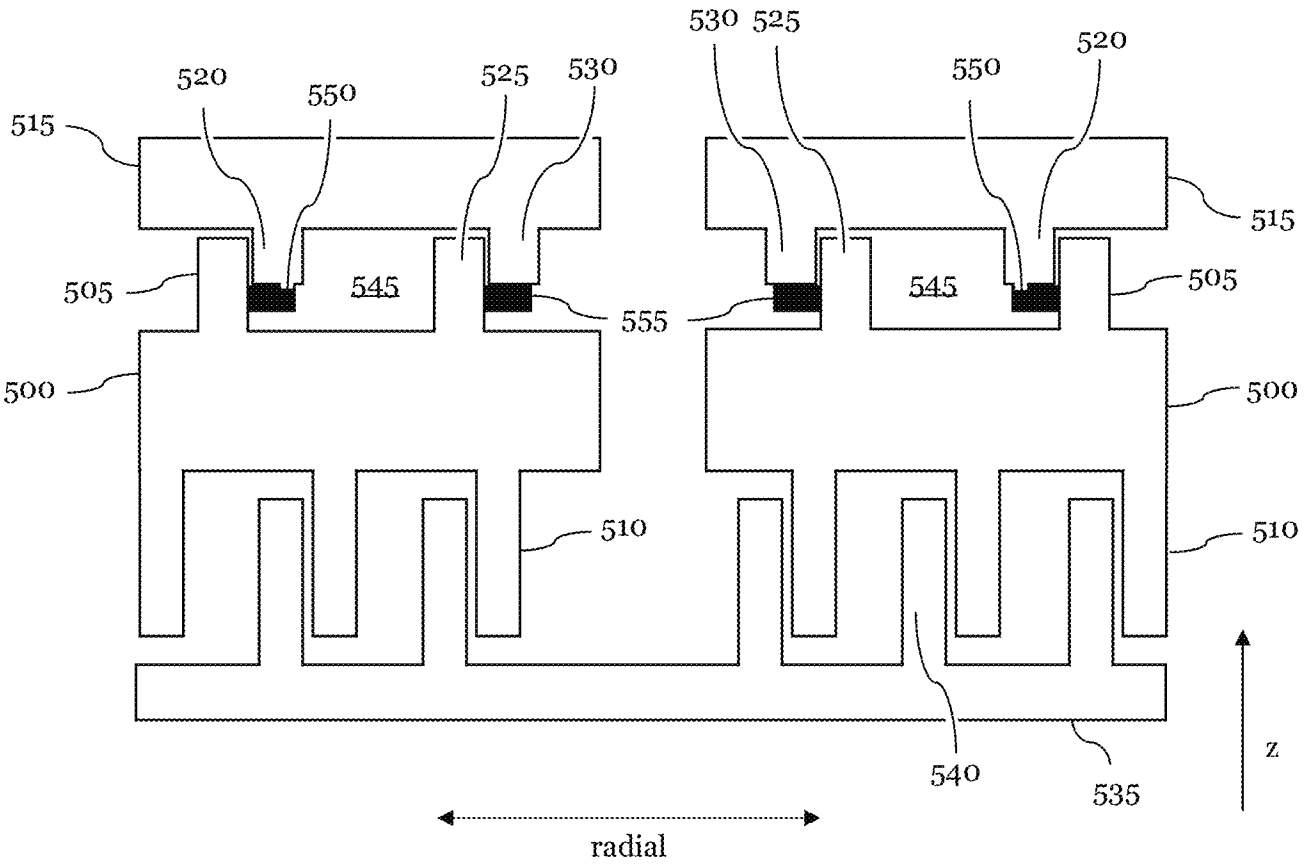
Figure 3B:
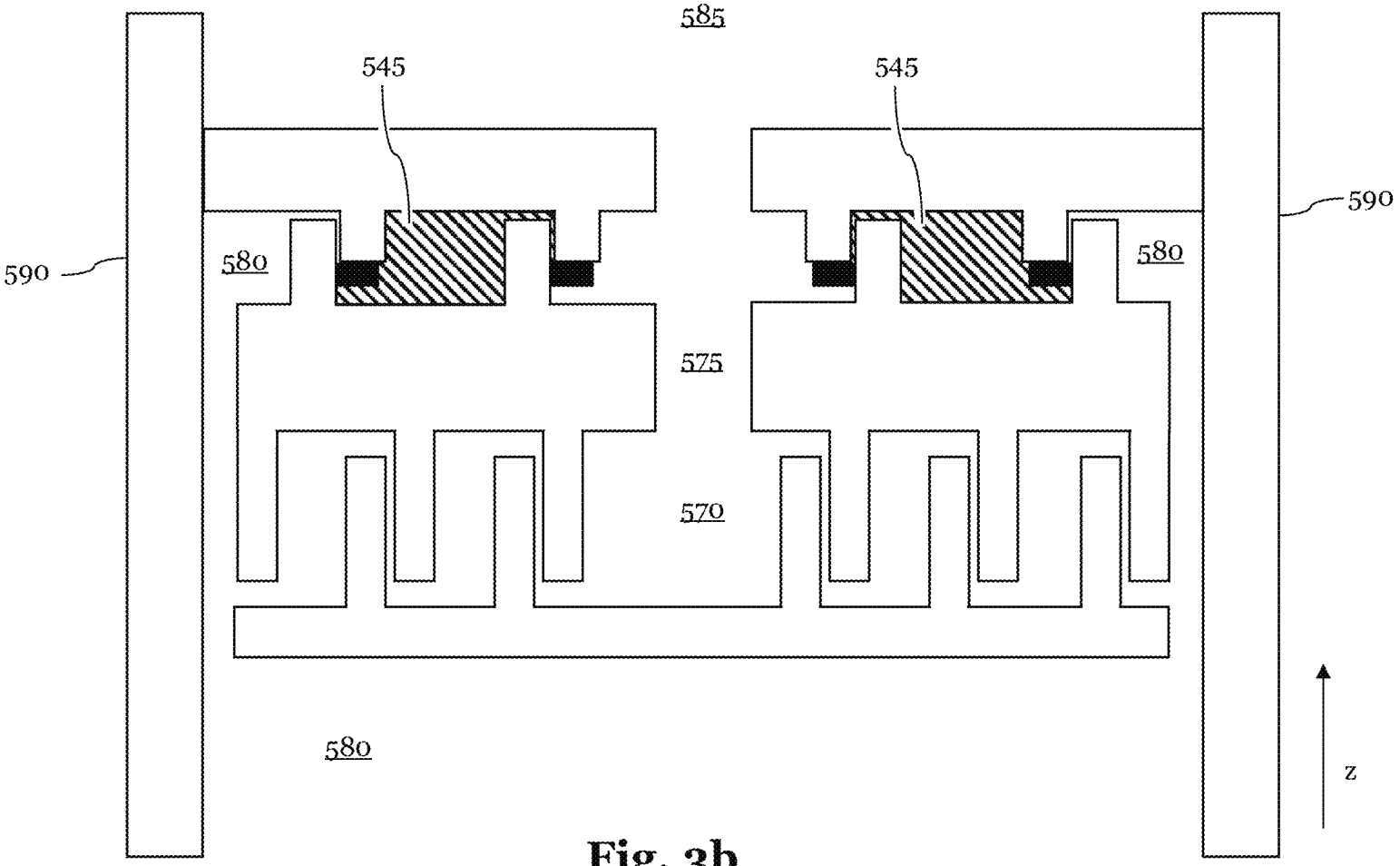

FIG. 3*a*, 3*b* show schematic views of the arrangement of the pilot plate, the stationary scroll plate and the orbiting scroll plate in a scroll compressor according to the current invention.

FIGS. 4*a* to 4*f* show different views of an exemplary seal for sealing a radial gap according to the current invention, wherein (a) shows a perspective view of a seal, (b) shows a perspective view of a seal plate, (c) shows a cross-sectional view of an L-shaped seal, (d) shows a cross-sectional view of a seal having an L-shape and an additional step, (e) shows a cross-section of the seal of (d) with an additional indication of the annular shape of the seal and (f) shows a cross-section of the seal of (e) being preconfigured on the seal plate.

FIGS. 5*a* to 5*e* illustrate buckling of an L-shaped seal, wherein (a) shows a cross-sectional view of a seal being free to buckle either upwards or downwards, with (b) illustrating buckling downwards and (c) illustrating buckling upwards. (d) shows a cross-sectional view of a seal being restricted at the top, which limits its buckling behavior to buckling downwards, wherein buckling downwards is illustrated in (e).

Figure 6A:
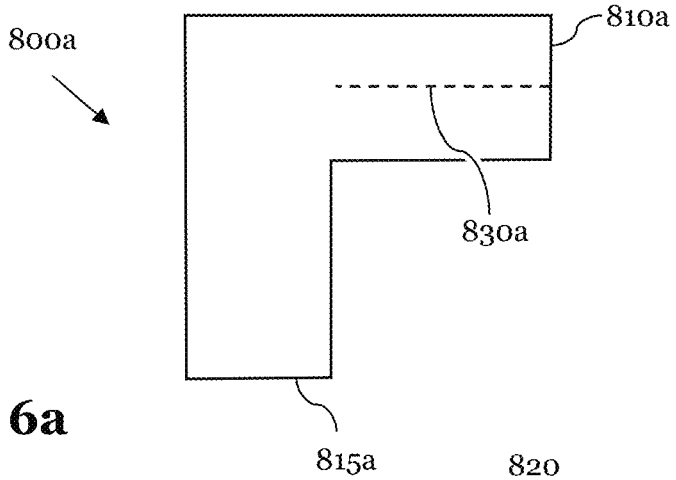
Figure 6B:
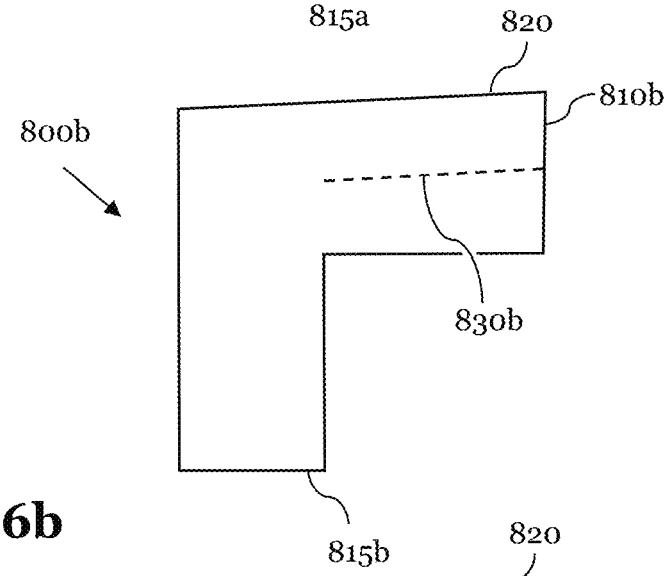
Figure 6C:
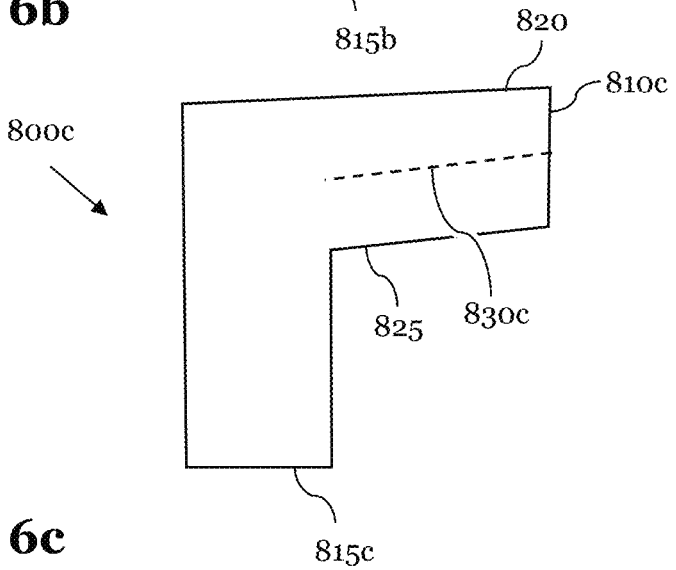

FIGS. 6*a* to 6*c* show cross-sectional views of an exemplary seal with an L-shaped cross-section with an anti-buckling feature, wherein (a) shows a regular L-shaped seal, (b) a seal with a tapered portion that provides an anti-buckling feature, and (c) a seal with two tapered portions that provide an anti-buckling feature.

Figure 7A:
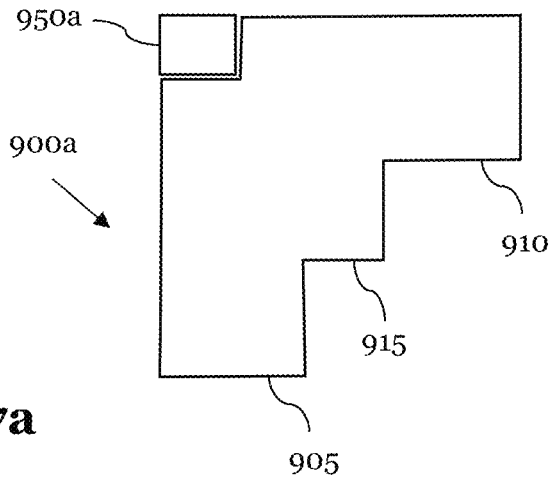
Figure 7B:
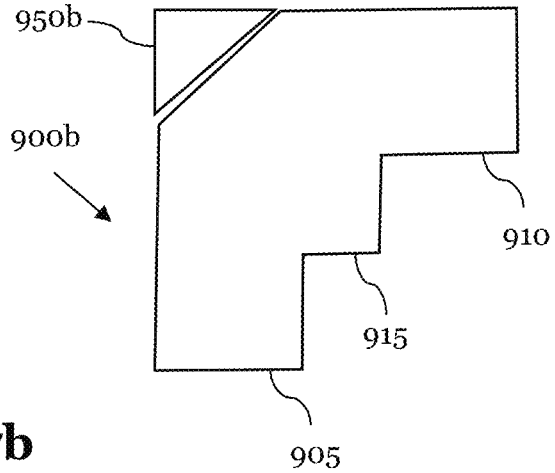
Figure 7C:
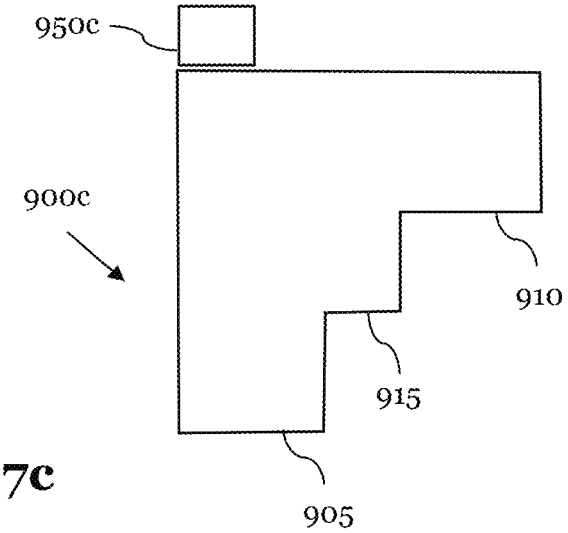

FIGS. 7*a* to 7*c* show cross-sectional views of an exemplary seal with an L-shaped cross-section with an annular metal ring, wherein (a), (b) and (c) show different configurations of the annular metal ring.

DETAILED DESCRIPTION

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

Figure 1:
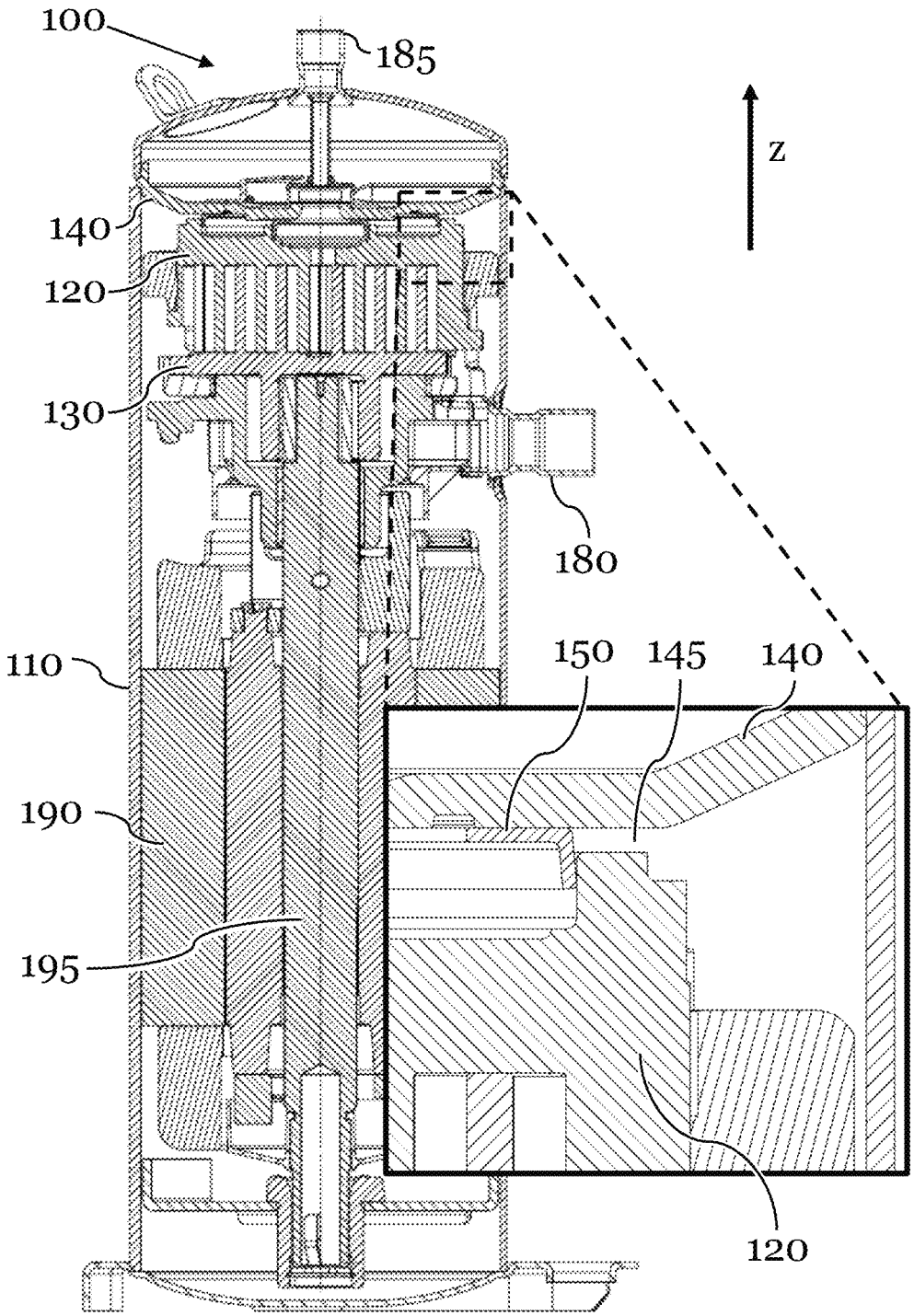
Fig. 1 Prior Art
FIG. 1 shows a cross-sectional view of an exemplary scroll compressor according to the state of the art including an enlarged section with an axial gap formed between the high-pressure side and the low-pressure side of the scroll compressor.

FIG. 1 shows a cross-sectional view of an exemplary scroll compressor 100 according to the state of the art. The scroll compressor 100 comprises a case 110, a suction port 180, a discharge port 185, a motor 190, a crankshaft 195, a stationary scroll plate 120 and an orbiting scroll plate 130. The scroll compressor 100 has a design with a high-pressure side and a low-pressure side, which are separated by a boundary 140. As can be seen in the enlarged section, the stationary scroll plate 120 has a top side, which contacts a bottom side of the boundary. In other words, the stationary scroll plate 120 is fixed within the case 110 of the scroll compressor wo in a way that the stationary scroll plate 120 is arranged below the boundary 140.

Between the stationary scroll plate 120 and the boundary 140, i.e. between the top surface of the stationary scroll plate 120 and the bottom surface of the boundary 140, a gap 145 is formed. The gap 145 is along the axial direction of the z direction as defined by the case no of the scroll compressor wo and indicated in FIG. 1. In order to prevent leakage from the low-pressure side to the high-pressure side, a seal 150 is provided in the axial gap 145.

In a typical scroll compressor, the stationary scroll plate is floating with respect to the boundary, so that the stationary scroll plate cannot be fixed directly at the boundary (e.g. by welding or fastening with a fastening means) in order to keep the gap manageable. However, such axial gaps are rather large, which leads to shortened lifetimes of the seal.

Figure 2:
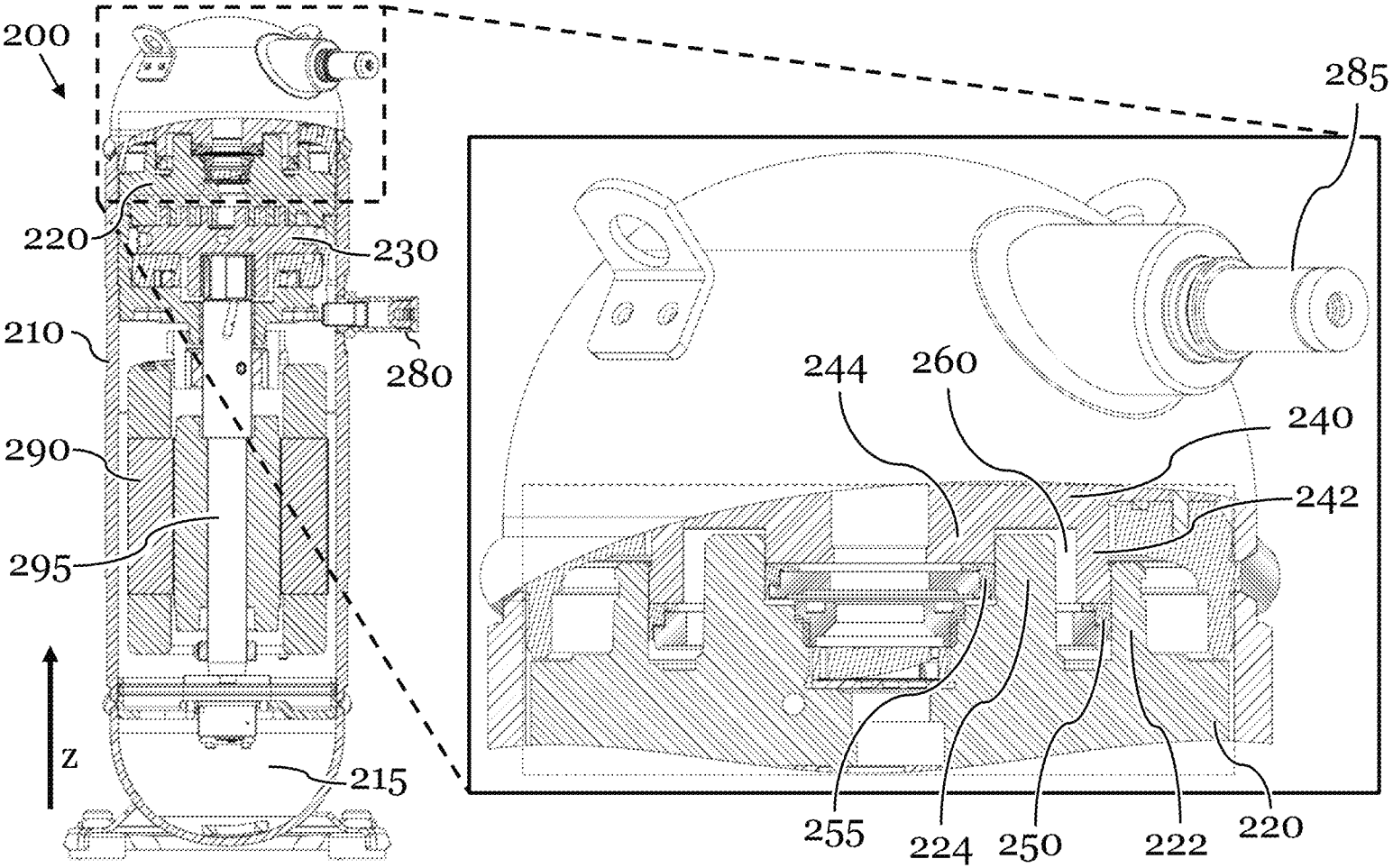
FIG. 2 shows a cross-sectional view of an exemplary scroll compressor according to the current invention including an enlarged section with radial gap formed between the high-pressure side and the low-pressure side of the scroll compressor.

FIG. 2 shows a cross-sectional view of an exemplary scroll compressor 200 according to the current invention including an enlarged section with radial gap formed between the high-pressure side and the low-pressure side of the scroll compressor. The scroll compressor 200 comprises a case 210, a suction port 280, a discharge port 285, a motor 290, a crankshaft 295, a stationary scroll plate 220 and an orbiting scroll plate 230. The scroll compressor 200 has a design with a high-pressure side and a low-pressure side. The high-pressure side and the low-pressure side are separated by a pilot plate 240. At the high-pressure side, a discharge port 285 is located for discharging compressed fluid. A transition area between the high-pressure side and the low-pressure side is provided in form of a scroll set formed by the stationary scroll plate 220 and the orbiting scroll plate 230. The transition area provides a passage from the low-pressure side through the pilot plate 240. At the low-pressure side, the scroll compressor 200 comprises the suction port 280 for receiving fluid. Further, the motor 290 and the crankshaft 295 connected to the motor 290 and the orbiting scroll plate 230 are located at the low-pressure side. A lubricant reservoir 215 is provided at the low-pressure side as well for providing lubricant to the motor 290, the crankshaft 295 and the scroll plates 220, 230.

As can be seen in the detailed enlarged section of FIG. 2, the stationary scroll plate 220 comprises a first protrusion 222 having an annular shape and the pilot plate 240 comprises a second protrusion 242 having an annular shape. The first and the second protrusions 222, 242 may be in close proximity to one another, as has been described above. This means that they barely do not contact each other, so that a small radial gap is formed between the annular protrusions 222, 242 around their circumference. The term radial refers to a direction perpendicular to the z direction defined by the case 210 of the compressor 200.

In the embodiment depicted in FIG. 2, the stationary scroll plate 220 comprises a third protrusion 224 and the pilot plate comprises a fourth protrusion 244. Said third and fourth protrusions 224, 244 also have annular shapes, however at a smaller diameter than the first and second protrusions 222, 242, meaning that the first and second protrusions 222, 242 surround the third and fourth protrusions 224, 244. The third and fourth protrusions 224, 244 may be in close proximity to one another, so that they form a radial gap along their circumference. Although it is possible that the third and fourth protrusions 224, 244 form concentric rings with the first and second protrusions 222, 242, this is not mandatory. Instead, it may also be possible that a center of the third and fourth protrusions 224, 244 is offset with respect to a center of the first and second protrusions 222, 242.

The radial gaps formed between the first and second protrusions 222, 242 and the third and fourth protrusions 224, 244, respectively, are sealed by annular seals 250 and 255, respectively.

Between the first and second protrusions 222, 242 and the third and fourth protrusions 224, 244, an intermediate pressure cavity 260 is formed by the stationary scroll plate 220 and the pilot plate 240. Said intermediate pressure cavity 260 may have a pressure higher than the low-pressure side, but smaller than the high-pressure side. Further, a bleed hole (not shown) may be provided which connects the intermediate pressure cavity 260 with a compression chamber formed between the stationary scroll plate 220 and the orbiting scroll plate 230 at least temporarily during the operation of the scroll compressor 200.

FIG. 3*a* shows a schematic view of the arrangement of the pilot plate, the stationary scroll plate and the orbiting scroll plate of a scroll compressor according to the current invention. A pilot plate 515, a stationary scroll plate 500 and an orbiting scroll plate 535 are illustrated.

The stationary scroll plate 500 comprises a first annular protrusion 505 and a third annular protrusion 525 on its second side and a spiral wrap 510 at its first side. In FIG. 3*a*, the first side of the stationary scroll plate may be referred to as bottom side and the second side of the stationary scroll plate may be referred to as top side. The orbiting scroll plate 535 comprises a spiral wrap 540. The spiral wraps 510, 540 are interleaved and form a means for compressing. In its center, the stationary scroll plate 500 comprises an opening, which forms an outlet of the means for compressing.

The pilot plate 515 is placed above the stationary scroll plate 500 and comprises a second annular protrusion 520 and a fourth annular protrusion 530 on its first side. In FIG. 3*a*, the first side of the pilot plate may be referred to as bottom side.

The first and second annular protrusions 505, 520 are in close proximity to one another and form a radial gap. The radial gap is sealed by a first annular seal 550. Also, the third and fourth annular protrusions 525, 530 are in close proximity to one another and form another radial gap. Said radial gap is sealed by a second annular seal 555, Between the pilot plate, the stationary scroll plate and the first, second, third, and fourth protrusions, an intermediate pressure cavity 545 is formed.

In FIG. 3*b* the intermediate pressure cavity 545 is highlighted as hatched area. Further, portions of the case 590 are indicated in order to illustrate the pressure areas within the compressor. The low-pressure side is located below the orbiting scroll plate and around the sides of the stationary scroll plate, as is indicated by reference numeral 580. The high-pressure side is located above the pilot plate, as is indicated by reference numeral 585.

Within the interleaved scroll plates, the means for compressing 570 is formed. The means for compressing 570 is connected to the high-pressure side 585 via a channel 575, which is formed by corresponding openings in the stationary scroll plate and the pilot plate. The intermediate pressure cavity is sealed from the low-pressure side 580 by ease of the first seal and sealed from the channel 575 between the means for compressing and the high-pressure side 585 by ease of the second seal.

FIGS. 4*a* to 4*f* show different views of an exemplary seal for sealing a radial gap according to the current invention, wherein (a) shows a perspective view of a seal, (b) shows a perspective view of a seal plate, (c) shows a cross-sectional view of an L-shaped seal, (d) shows a cross-sectional view of a seal having an L-shape and an additional step, (e) shows a cross-section of the seal of (d) with an additional indication of the annular shape of the seal and (f) shows a cross-section of the seal of (e) being preconfigured on the seal plate.

Figure 4A:
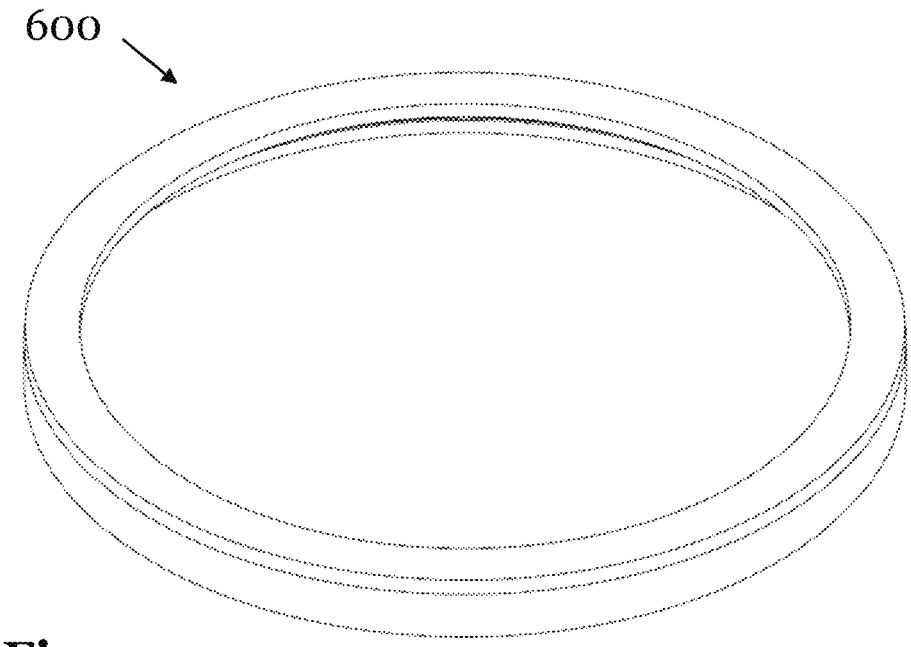
Figure 4B:
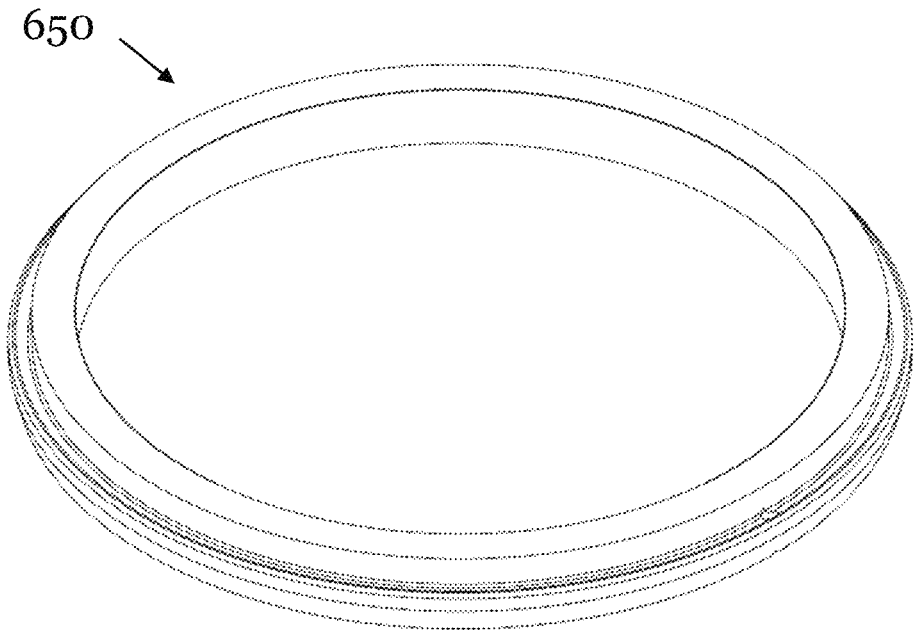

FIG. 4*a* shows a perspective view of an embodiment of a seal 600. In the preferred embodiment depicted in FIG. 4*a*, the seal has an annular shape and is configured to be seal a radial gap formed between annular protrusion. Preferably, the seal 600 is attached to a seal plate 650 depicted in FIG. 4*b* because this reduces the magnitude of seal shrinkage.

Figure 4C:
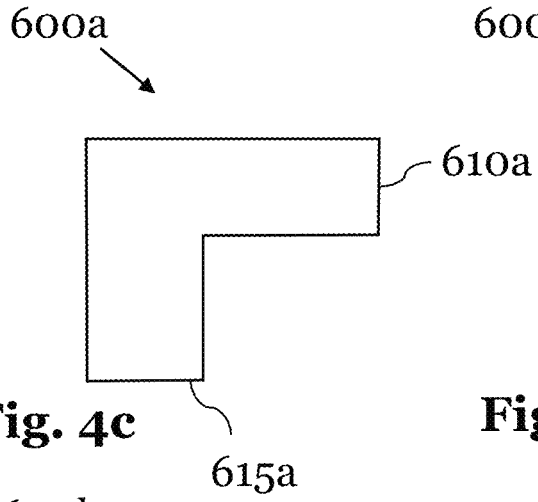

FIG. 4*c* shows a cross-sectional view of an L-shaped seal 600*a*. In a perspective view, the L-shaped seal 600*a* may look similar to seal 600 depicted in FIG. 4*a*. The L-shape is formed by a first leg 615*a* and a second leg 615*a*. The legs may form an angle of approximately 90 degrees between them.

Figure 4D:
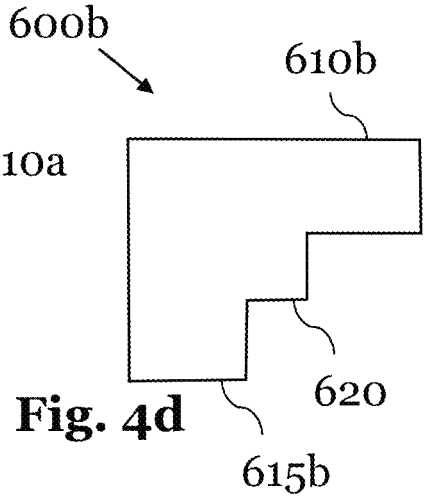

FIG. 4*d* shows a cross-sectional view of an L-shaped seal 600*b* with an additional step 620. In a perspective view, the L-shaped seal 600*b* may look similar to seal 600 depicted in FIG. 4*a*, since the step may not be visible in the perspective view. The L-shape is formed by a first leg 610*b* and a second leg 615*b*. The legs may form an angle of approximately 90 degrees between them. The step 620 is located between the legs 610*b*, 615*b* at a location where the 90 degree angle is formed. The step 620 increases the stiffness of the seal and prevents the seal 600*b* from being drawn into the gap that is to be sealed.

Figure 4E:
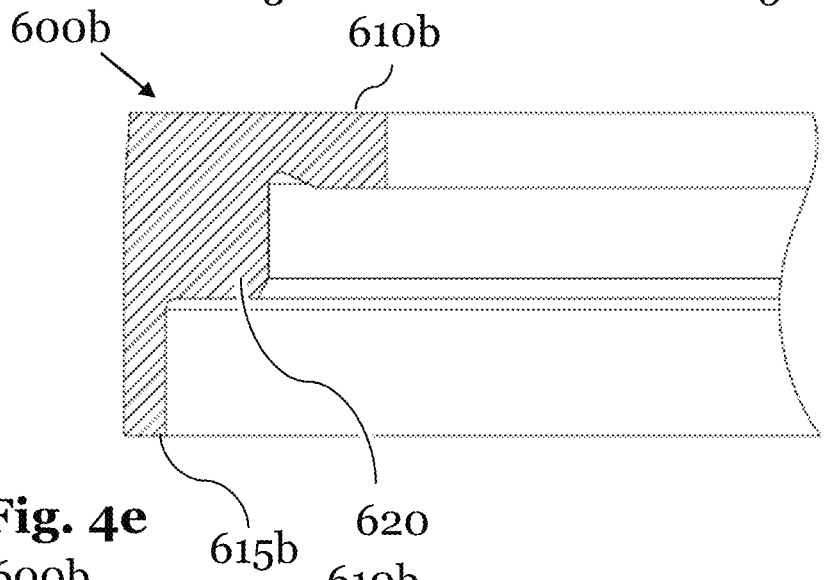
Figure 4F:
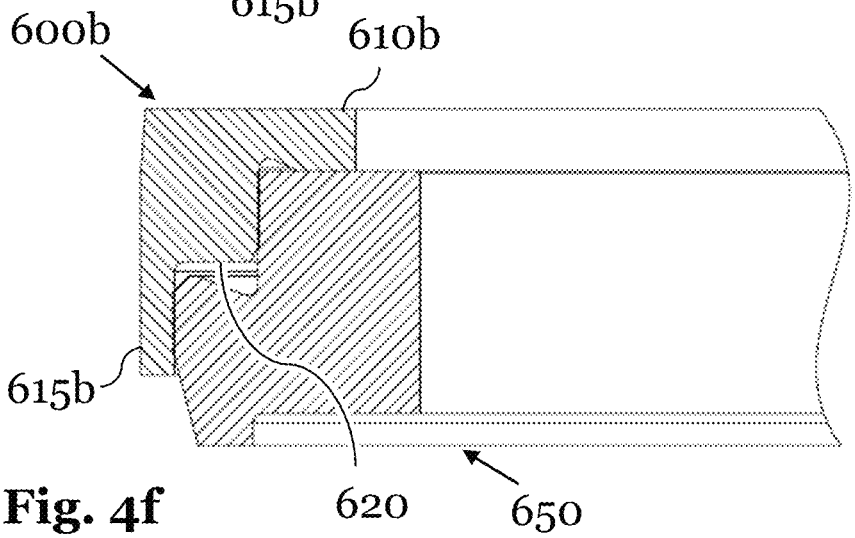

FIG. 4*e* shows an alternative cross-section of the seal 600*b*. Again, the first and second legs 610*b*, 615*b*, 620 are shown. Further, the annular shape is indicated by illustrating a portion of the annular seal located outside of the plane of the cross-section, which is identified by the hatched area. FIG. 4*f* shows a cross-sectional view of the seal 600*b* attached to a seal plate 650, wherein the view is similar to the view in figure v.

FIGS. 5*a* to 5*e* illustrate buckling of a seal, wherein (a) shows a cross-sectional view of an L-shaped seal being free to buckle either upwards or downwards, with (b) illustrating buckling downwards and (c) illustrating buckling upwards. (d) shows a cross-sectional view of a seal being restricted at the top, which limits its buckling behavior to buckling downwards, wherein buckling downwards is illustrated in (e).

Figure 5A:
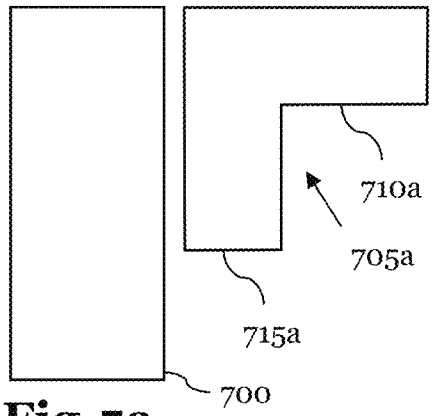

The seal 705*a* depicted in FIG. 5*a* is an L-shaped seal, wherein the L-shape is formed by a first leg 710*a* and a second leg 715*a*, which extend in an angle of approximately 90 degrees with respect to one another. The configuration depicted in FIG. 5*a* illustrates a seal, which is restricted at its outer diameter by a protrusion 700 of the stationary scroll plate.

Figure 5B:
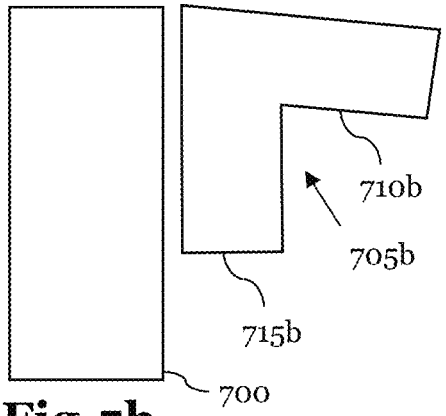
Figure 5C:
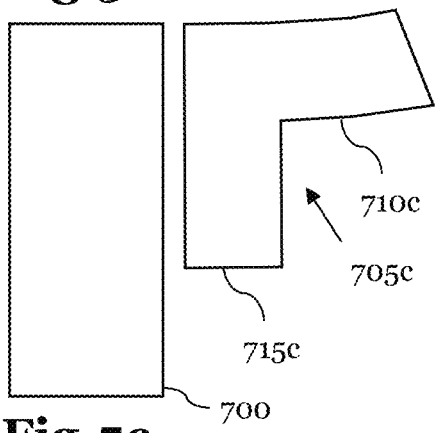

Caused by forces created during compressor operation, like e.g. thermal deformation, the seal 705*a* can buckle either upwards or downwards. Typical seals may be made from synthetic polymers, for example Teflon, while the stationary scroll plate and the pilot plate may be made from cast iron. Teflon has a thermal expansion coefficient, which is five times the thermal expansion coefficient of cast iron. When the operating temperature increases, the expansion of the seal is restricted by the stationary scroll plate, which generates compressive stress inside the seal. This compressive stress may lead to buckling as is depicted in FIGS. 5*b* and 5*c*. FIG. 5*b* illustrates a seal 705*b*, which may be similar to the seal 705*a* of FIG. 5*a* but with first leg 710*b* and second leg 715*b*. The seal 705*b* buckles downwards. As can be seen, the first leg 710*b* is deformed and tends to move downwards, i.e. it buckles downwards. In contrast, FIG. 5*c* illustrates a seal 705*c*, which may be similar to the seal 705*a* of FIG. 5*a* but with first leg 710*c* and second leg 715*c*. The seal 705*c* buckles upwards. As can be seen, the first leg 710*c* is deformed and tends to move upwards, i.e. it buckles upwards.

Figure 5D:
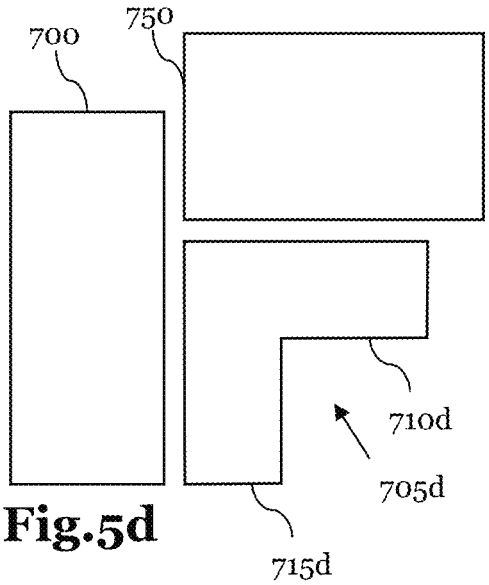
Figure 5E:
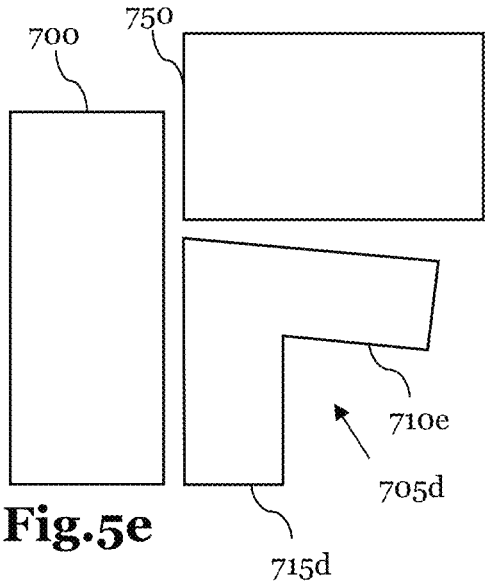

In the configuration of the scroll compressor according to the current invention, the seal is not only restricted by the annular protrusion of the stationary scroll plate, but also by the annular protrusion of the pilot plate. This is illustrated in FIG. 5*d*, where a seal 705*d* is shown, which is restricted by the first protrusion 700 and the second protrusion 750. The seal 705*d* may be similar to the seal 705*a* of FIG. 5*a* but with first leg 710*d* and second leg 715*d*. The protrusion 750 of the pilot plate is shown in a way that the front surface of the protrusion contacts the first leg 710*d* of the seal 705*d*. This restriction prevents the seal from buckling upwards. Accordingly, the first leg 705*d* can only buckle downwards as is illustrated by the deformed leg 710*e* depicted in FIG. 5*e*.

FIGS. 6*a* to 6*c* show cross-sectional views of an exemplary seal with an L-shaped cross-section with an anti-buckling feature, wherein (a) shows a regular L-shaped seal, (b) a seal with a tapered portion that provides an anti-buckling feature, and (c) a seal with two tapered portions that provide an anti-buckling feature.

FIG. 6*a* shows an L-shaped seal 800*a* having a first leg 810*a* and a second leg 815*a*. Such a seal may be prone to buckling. This can be illustrated by the dashed line 830*a*, which corresponds to the middle line of the seal thickness in the first leg 810*a*. Here, the middle line 830*a* is horizontal, which means that the first leg 810*a* is not biased and the seal may buckle downwards or upwards when compression stress develops inside the first leg 810*a* of the seal 800*a*.

FIGS. 6*b* and 6*c* show seals 800*b*, 800*c*, which have a so-called anti-buckling feature. The anti-buckling feature reduces the chance of the seal buckling downwards by changing the symmetry of the seal. In FIG. 6*b*, the anti-buckling feature has the form of a taper 820. The taper 820 is added to the first leg 810*b* and is most effective in reducing the buckling downwards, because an asymmetry is created for the first leg 810*b*. This asymmetry is illustrated by the dashed line 830*b*, which again corresponds to the middle line of the seal thickness in the first leg 810*b*. From left to right, the dashed line tends upwards, thereby indicating a tendency of buckling upwards upon compression stress. However, upwards buckling is restricted by the protrusion of the pilot plate, therefore buckling is almost entirely eliminated. The asymmetry of the first leg can be enhanced by adding a taper 820, 825 to both sides of the first leg 810*c* of seal 800*c* as is illustrated by the dashed line 830*c* shown in FIG. 6*c*. Alternatively, a taper 825 could also be added only to the bottom side of the first leg 810*c*.

FIGS. 7*a* to 7*c* show cross-sectional views of exemplary seals with an L-shaped cross-section and a step in combination with a ring, wherein (a), (b) and (c) show different configurations of the ring. The seals 900*a*, 900*b*, 900*c* each comprise a first leg 910 and a second leg 905 and a step 915 for additional stiffness. In the figures, different configurations of the ring 950*a*, 950*b*, 950*c* are illustrated. The first two configurations rest in a recess within the seal 900*a*, 900*b*, while the third alternative is used with a seal 900*c* without an additional recess. The ring may float within the first annular protrusion. Thereby, the ring may reduce the maximum radial gap that the seal needs to seal, which further improves the sealing. The ring may made of a material which has a similar thermal expansion property as the stationary scroll plate. Preferably, the ring may be a metal ring. However, also non-metal materials, which have similar thermal expansion properties, are also possible.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the scope of the appended claims.

The invention claimed is:

1. A scroll compressor comprising:

a case having a high-pressure side and a low-pressure side;

a stationary scroll plate having a base plate with a first side having at least one projection, which forms a spiral wrap, and a second side having a first annular protrusion;

a pilot plate for separating the high-pressure side of the case from the low-pressure side of the case and the pilot plate abutting the second side of the stationary scroll plate, wherein the pilot plate has a first side, wherein the first side faces the second side of the stationary scroll plate and wherein the first side has a second annular protrusion; and a seal, wherein the seal is at least partially made from a synthetic polymer composed of polyamides, polytetrafluoroethylene, PTFE, polyether ether ketone, PEEK, or polyimide-based plastics, wherein the seal seals a radial gap between the first annular protrusion and the second annular protrusion, wherein the seal has an annular shape with an L-shaped cross-section having a first leg and a second leg extending at an angle of approximately 90 degrees, and wherein an anti-buckling feature in the form of a taper is added to the first leg.

2. The scroll compressor according to claim 1, wherein a step is located between the first leg and the second leg.

3. The scroll compressor according to claim 1, wherein the first leg abuts a front surface of the second annular protrusion and the second leg abuts a side of the first annular protrusion; or the first leg abuts a front surface of the first annular protrusion and the second leg abuts a side of the second annular protrusion.

4. The scroll compressor according to claim 1, wherein an exterior surface of the tapered leg forms an inclined plane with an angle of approximately 5 degrees with respect to the approximately 90 degrees between the first leg and the second leg.

5. The scroll compressor according to claim 1, further comprising:

a ring being placed at the radial gap between the first annular protrusion and the second annular protrusion and having a rectangular or triangular cross-section.

6. The scroll compressor according to claim 5, wherein the L-shaped seal comprises an annular recess opposite of the step and wherein the ring is located in the recess of the L-shaped seal.

7. The scroll compressor according to claim 1, wherein the seal is assembled on a seal plate.

8. The scroll compressor according to claim 7, wherein the seal plate is made from steel or cast iron.

9. The scroll compressor according to claim 1, wherein the second side of the stationary scroll plate further comprises a third annular protrusion having a smaller diameter than the first annular protrusion;

wherein the first side of the pilot plate further comprises a fourth annular protrusion having a smaller diameter than the second annular protrusion; and wherein the seal is a first seal and the compressor further comprises a second seal, which seals a radial gap between the third annular protrusion and the fourth annular protrusion.

10. The scroll compressor according to claim 9, wherein an intermediate pressure cavity is formed between the first side of the pilot plate and the second side of the stationary scroll plate as well as the first, second, third and fourth protrusions.

11. The scroll compressor according to claim 10, further comprising an orbiting scroll plate, wherein the stationary scroll plate and the orbiting scroll plate form a means for compressing;

wherein the stationary scroll plate comprises an opening, which forms an outlet of the means for compressing;

wherein the pilot plate comprises a corresponding opening and wherein both openings form a channel from the means for compressing to the high-pressure side; and wherein the first seal seals the intermediate pressure cavity from the low-pressure side and wherein the second seal seals the intermediate pressure cavity from the channel between the outlet of the means for compressing and the high-pressure side.

12. The scroll compressor according to claim 9, wherein the second seal has a configuration which is similar to any of the configurations of the first seal according to claim 1.

* * * * *